US010806237B1

(12) United States Patent
Popovic

(10) Patent No.: US 10,806,237 B1
(45) Date of Patent: Oct. 20, 2020

(54) BACKPACK HAVING DETACHABLE STRAPS AND ADJUSTABLE IN POSITION ON USER

(71) Applicant: Zarko Popovic, Zagreb (HR)

(72) Inventor: Zarko Popovic, Zagreb (HR)

( * ) Notice: Subject to any disclaimer, the term of this patent is extended or adjusted under 35 U.S.C. 154(b) by 0 days.

(21) Appl. No.: 16/563,040

(22) Filed: Sep. 6, 2019

(51) Int. Cl.
*A45F 3/08* (2006.01)
*A45F 3/04* (2006.01)

(52) U.S. Cl.
CPC ..... *A45F 3/047* (2013.01)

(58) Field of Classification Search
CPC .... A45F 3/047; A45F 3/04; A45F 3/08; A45F 2003/045; A45F 3/12; A45F 3/10; A45F 3/14; A45F 3/06; F41H 1/02
USPC ..... 224/631–632, 650
See application file for complete search history.

(56) References Cited

U.S. PATENT DOCUMENTS 7,152,771 B2 * 12/2006 Le Gal ..... A45F 3/047 224/631
7,762,096 B2 * 7/2010 Fuchs ..... A41D 13/0055 62/259.3
8,561,866 B2 * 10/2013 Gleason, Jr. ..... A45F 3/12 224/631
9,192,221 B2 * 11/2015 Just ..... A45C 13/02
9,826,816 B1 * 11/2017 Chang ..... A45F 3/08
2011/0284609 A1 * 11/2011 McGill ..... A45F 3/047 224/633
2012/0192335 A1 * 8/2012 Crye ..... A41D 13/0007 2/102
2020/0025523 A1 * 1/2020 Ross ..... A45F 3/06

* cited by examiner

*Primary Examiner* — Adam J Waggenspack
(74) *Attorney, Agent, or Firm* — Ohlandt, Greeley, Ruggiero & Perle, L.L.P.

(57) ABSTRACT

A system for attaching shoulder straps to a backpack, comprising a detachable shoulder strap assembly including shoulder straps, a yoke to which the shoulder straps are attached, and at least one lower strap attached to the yoke, wherein the yoke has a slit formed therein; a sleeve for attachment to the backpack, the sleeve having an upper part associated with a series of loops positioned and configured to extend through the slit; a securing member for securing the loops to the yoke; and for each of the at least one lower strap, a strap fastener for attachment to the backpack for securing the at least one strap to the backpack. A method for using the system to attach and detach the detachable shoulder strap assembly.

18 Claims, 8 Drawing Sheets

BACKPACK HAVING DETACHABLE STRAPS AND ADJUSTABLE IN POSITION ON USER

BACKGROUND OF THE DISCLOSURE

1. Field of the Disclosure

The present disclosure relates to load carrying systems and to a method of attaching a load carrying apparatus to a carrier. More particularly it relates to a backpack and the attachment of a carrying harness to a backpack.

2. Description of the Related Art

Conventional backpacks, usually of external or internal frame construction, as described in U.S. Pat. No. 8,561,866, generally attempt to transfer the weight of the load in a backpack primarily to the hips of a person wearing the backpack with a harness secured at the waist. Generally, a portion of the weight is also supported by means associated with the shoulders, such as shoulder straps.

A difficulty associated with conventional backpacks is that it is difficult to impossible to adjust the position of the backpack along the back of the user. This may result in discomfort to the user, or the user feeling unbalanced or ill at ease when carrying a heavy load in the backpack, and in some cases may result in unnecessary and excessive fatigue. Furthermore, heavy loads place stress on the spine and shoulders of the user, causing muscle strain and fatigue. Sometimes the user suffers pains that cause the user to seek medical attention. Too much weight or frequent use of badly positioned backpack can also lead to poor posture and excessive slouching of the user.

A further difficulty associated with conventional backpacks is that it may not be possible to attach and detach shoulder straps. This makes it difficult for a user to switch to a different backpack when the need arises, such as due to a change in required equipment necessary to support a specific operation, or different phases of a complex, ongoing operation.

Thus, there is a need for a backpack wherein the position of the backpack on the person can be readily adjusted as needed to assure maximum comfort.

There is also a need for backpack and shoulder strap arrangement wherein the backpack can be readily attached and detached from the shoulder strap arrangement.

SUMMARY OF THE DISCLOSURE

A system is provided which allows a detachable shoulder strap assembly to be attached to and detached from a backpack. The position of the backpack on the back of a user carrying the backpack is adjustable. A variety of loads can be carried, including, for example, and not by way of limitation, equipment used by a member of the military, police or rescue teams, or by hikers, sports or adventure enthusiasts, or musical instruments or camping equipment.

In general, the disclosure is directed to a system for attaching shoulder straps to a backpack, comprising a detachable shoulder strap assembly including shoulder straps, a yoke to which the shoulder straps are attached, and at least one lower strap attached to the yoke, wherein the yoke has a slit formed therein; a sleeve affixed the back the backpack for attachment to the backpack, the sleeve having an upper part associated with a series of loops positioned and configured to extend through the slit; a securing member for securing the loops to the yoke; and for each of the at least one lower strap, a strap fastener for attachment to the backpack for securing the at least one strap to the backpack. The configuration provides precision in the adjustment of the backpack with respect to the shoulder strap assembly and thus precision of the positioning of the backpack on the user.

The yoke of the shoulder straps can be inserted into the upper openable part of the sleeve and its vertical slit can be entered upon the band inside the sleeve.

A disclosed embodiment is directed to a system for attaching shoulder straps to a backpack, comprising a detachable shoulder strap assembly including shoulder straps, a yoke to which the shoulder straps are attached, and at least one lower strap attached to the yoke, wherein the yoke has a slit formed therein; a sleeve for attachment of the yoke to the backpack, the sleeve having an upper part associated with a series of loops positioned and configured to extend through the slit; a securing member for securing the loops to the yoke; and for each of the at least one lower strap, a strap fastener for attachment to the backpack for securing the at least one strap to the backpack.

The securing member can comprise a lacing string. A button operated, quick string release can be associated with the lacing string. The lacing string is used to form a ladder lock along the loops.

The series of loops can extend for a distance longer than a length of the slit. The detachable shoulder strap assembly can be positioned so that one of a series of continuous subsets of the loops is positioned to extend through the slit, to adjust the position of the backpack with respect to the detachable shoulder strap assembly. The position of the backpack with respect to the sleeve determines position of the backpack with respect to the back of a person carrying the backpack upon selection of which of a series of continuous subsets of the loops is positioned to extend through the slit.

The sleeve can have a lower portion configured as a pocket. The pocket can be of sufficient size for storing at least the securing member. The strap fastener can comprise a loop buckle. The upper part of the sleeve can further comprise at least one flap for providing access to the series of loops. The loops can be attached to the sleeve. Alternatively, the loops can be attached to the backpack and extend through an opening in the sleeve and through the slit.

The system can further comprise a backpack to which the sleeve is attached.

An embodiment of the disclosure is directed to a method for releasably securing a detachable shoulder strap assembly to a backpack, comprising: providing a detachable shoulder strap assembly including shoulder straps, a yoke to which the shoulder straps are attached, and at least one lower strap attached to the yoke, wherein the yoke has a slit formed therein; attaching to the backpack a sleeve having an upper part associated with a series of loops positioned and configured to extend through the slit; securing the yoke to the loops; and attaching the at least one lower strap, to the backpack.

The method can further comprise using a lacing string to secure the yoke to the loops. The lacing string can be used to form a ladder lock.

BRIEF DESCRIPTION OF THE DRAWINGS

A component or a feature that is common to more than one drawing is indicated with the same reference number in each of the drawings.

DESCRIPTION OF THE EMBODIMENTS

Figure 1:
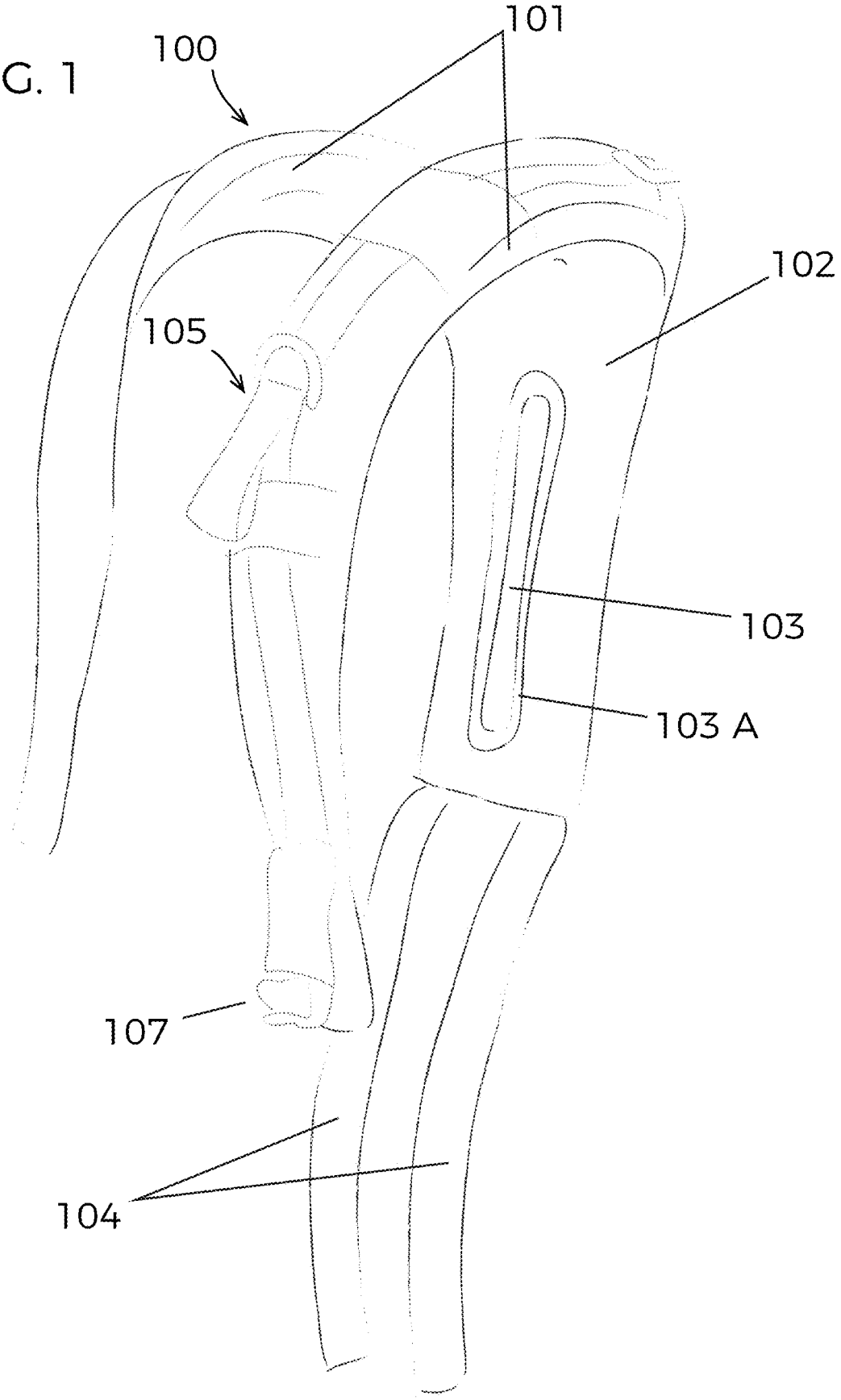
FIG. 1 is a perspective view of a detachable shoulder strap assembly for use with a backpack in accordance with the disclosed embodiment.
Figure 2:
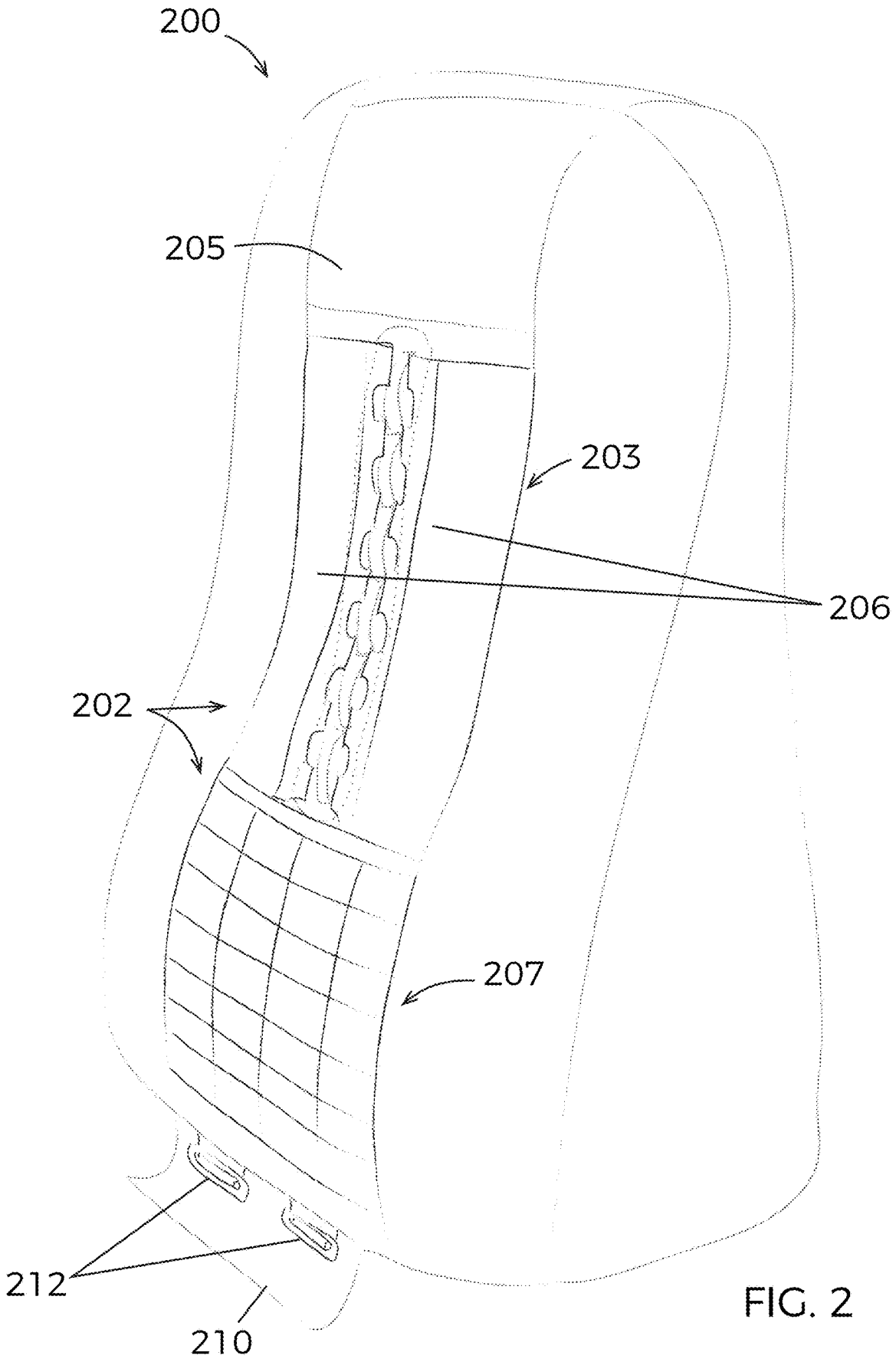
FIG. 2 is a perspective view of a backpack configured for use with the shoulder strap assembly of FIG. 1.

Referring to FIG. 1 and FIG. 2, the two major parts of the disclosed backpack system are the detachable shoulder straps assembly shown generally as 100 in FIG. 1, and a sleeve shown generally as 202 attached to the back 205 of a backpack shown generally as 200. Sleeve 202 is affixed, preferably by being sutured, to the back 205 of backpack 200 in any of several well-known ways.

In FIG. 1, the detachable shoulder strap assembly 100 includes shoulder straps 101 which are connected to a yoke 102. As is well known in the art, shoulder straps 101 may be fitted with appropriate padding to provide comfort when being worn by a user to carry backpack 200. A vertical slit 103, which is preferably re-enforced around its edge 103A, is in the central part of the yoke 102. Two lower straps 104 are attached at the bottom edge of the yoke 102. The shoulder straps 101 are preferably adjustable in length by a strap length adjuster shown generally on one of the straps 101 at 105, of a type well known in the art, but typically found on both straps 101. A buckle 107, of a type well known in the art, may also be placed at the end of each of straps 101 to allow fastening of the straps 101 to a waist band or other support (not shown) of a type well known in the art.

Figure 3:
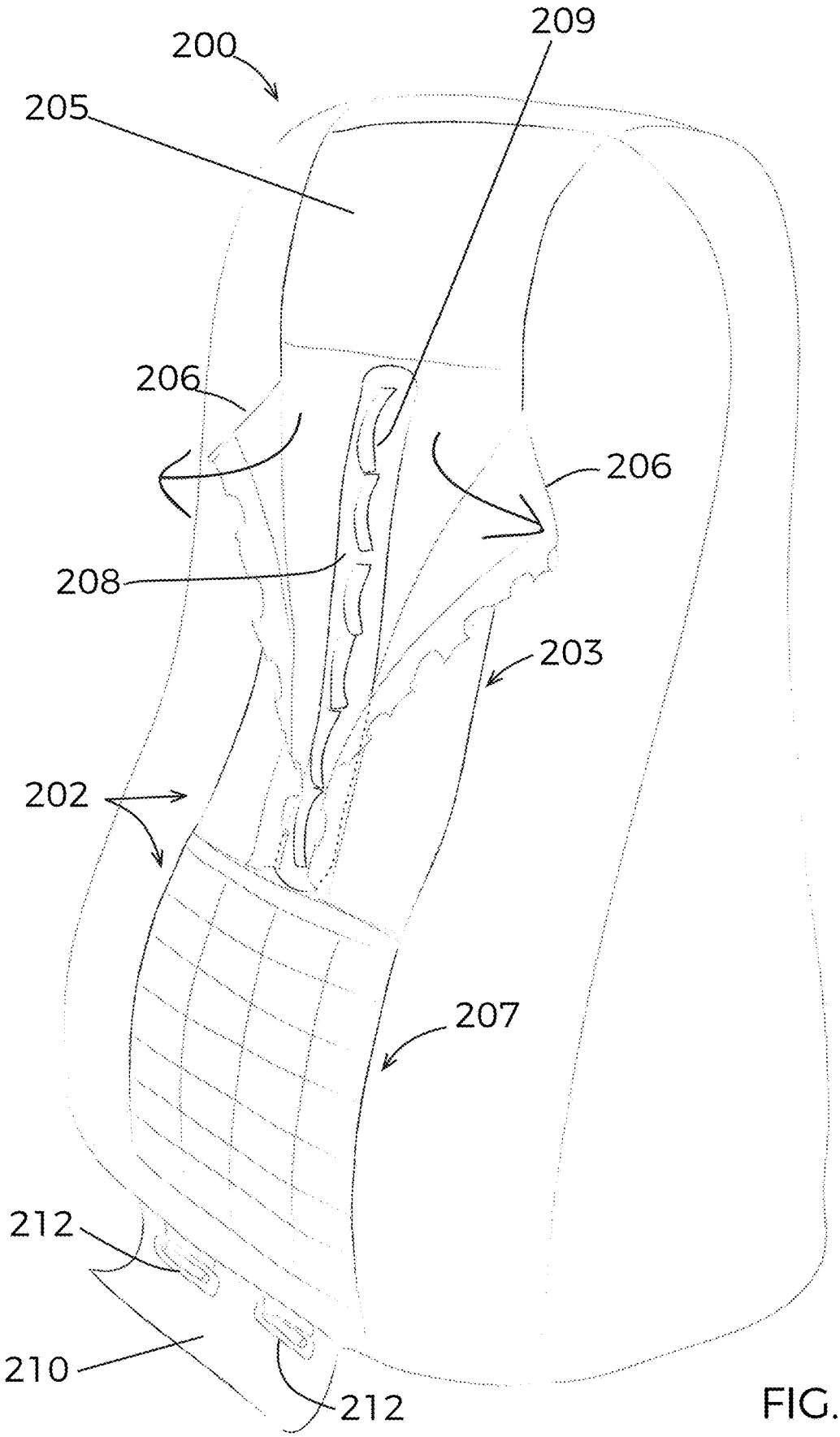
FIG. 3 is a perspective view of the backpack of FIG. 2, with a covering portion pulled back to expose an underlying portion thereof.

Referring to FIG. 2 and FIG. 3, the sleeve 202 is attached to the back 205 of the backpack 200 and includes an openable upper part 203, having two flaps 206, and a lower flat part 207. The vertical edge portions of flaps 206 can be releasably secure to upper part 203 of sleeve 202, with, for example, a hook and loop fabric fastener (not shown) having corresponding opposing portions on flaps 206 and the inside surface of lower flat part 207 of sleeve 202.

Lower flat part 207 may be formed of two portions, one of which is visible in the various figures, and the other of which is behind the visible portion and is sandwiched between the visible portion and the back 205 of backpack 200, so as to in effect form a pocket. The configuration described is opened at the top and bottom of lower flat part 207, for a mode of attachment of detachable shoulder straps assembly 100 to backpack 200, as described below. Sleeve 202 has on its surface a vertical band 208 having protruding therefrom a series of loops 209 disposed to be substantially surrounded by flaps 206 of the openable upper part 203 of sleeve 202. While it may be attached in a variety of ways, vertical band 208 preferably is sutured to the back 205 of backpack 200.

As an alternative, instead of a vertical band 208, an elongate slot may be provided as an opening in sleeve 202 through which loops, such as loops 209, attached to the back 205 of backpack 200, may protrude. However, this approach has the disadvantage of requiring backpack 200 to be of a specialized structure to support such loops on its back 205.

Figure 4:
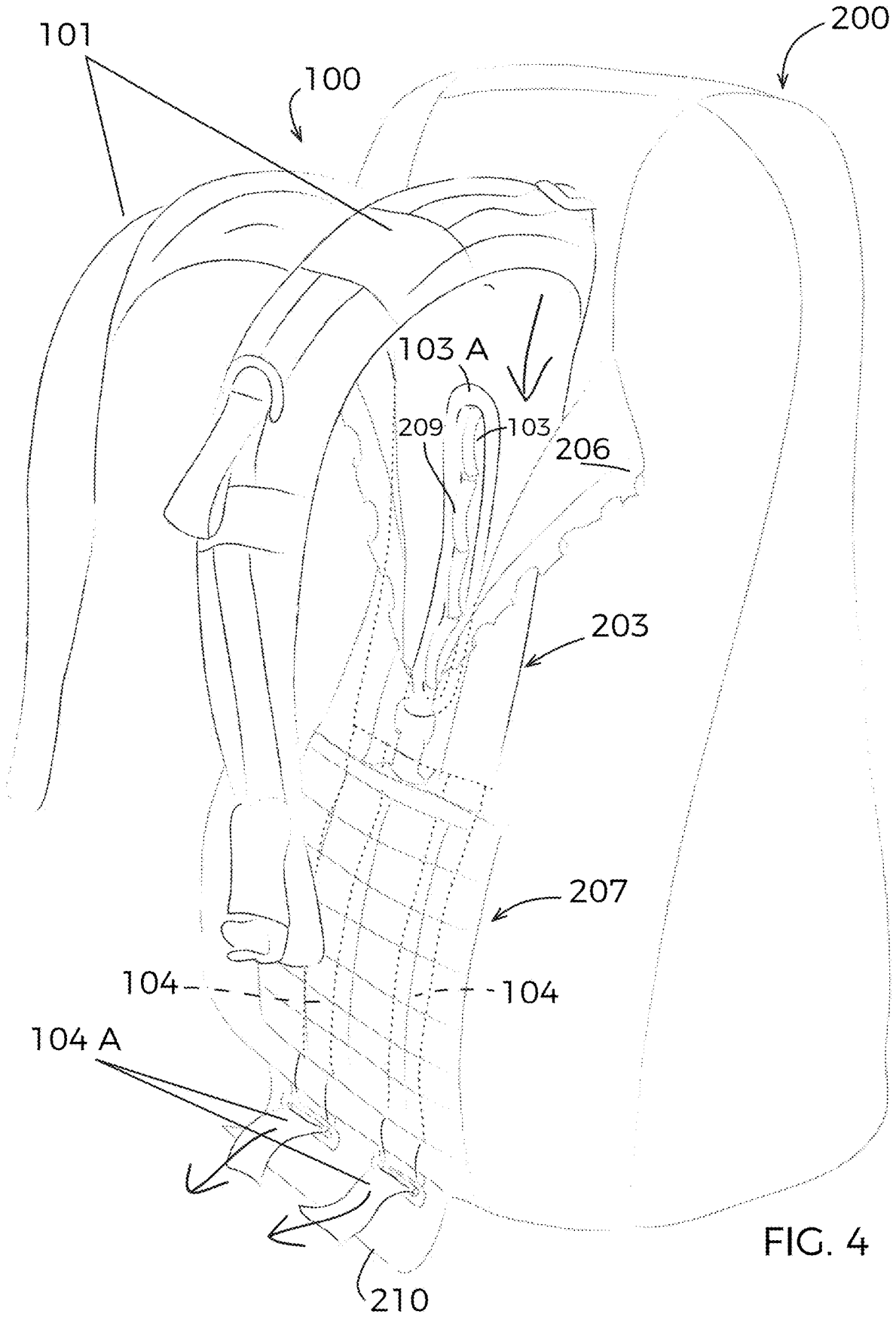
FIG. 4 is a perspective view of the shoulder strap assembly of FIG. 1 being assembled to the backpack of FIG. 2 and FIG. 3.

Referring to FIG. 3 and FIG. 4, the bottom edges or portions of the flaps 206 of the openable upper parts of sleeve 203 are affixed, preferably by being sutured, to the back 205 of the backpack 200. As evident in FIG. 3, FIG. 4 and FIG. 5, the upper parts of flaps 206 are not so affixed or sutured and are thus movable and openable.

Backpack 200 has attached thereto at its bottom a pocket flap 210, for use as also described below. Backpack 200 advantageously also has attached thereto at its bottom a pair of loop type buckles 212, each for receiving and securing one of straps 101, as described below.

Figure 5:
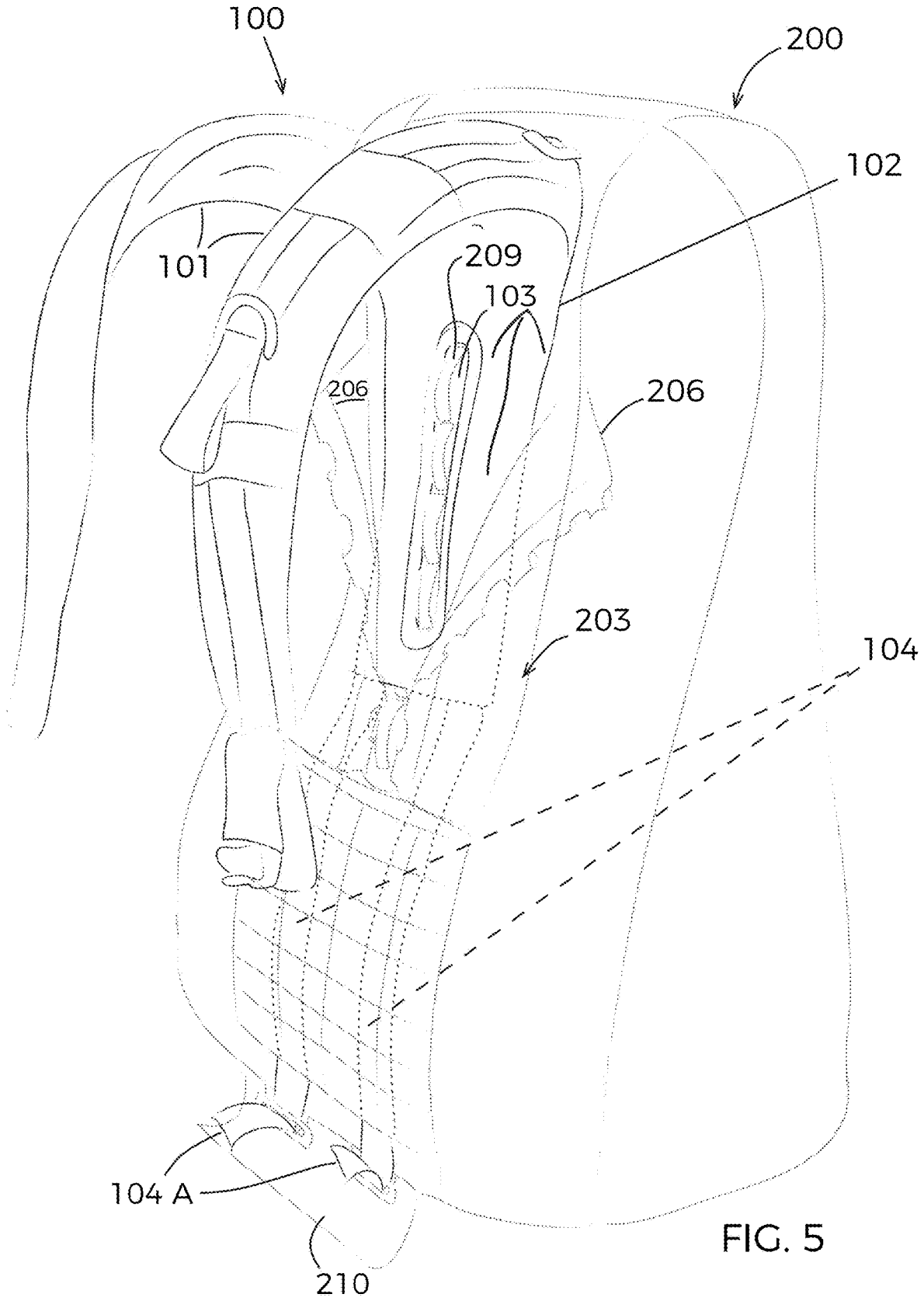
FIG. 5 is a perspective view of the shoulder strap of FIG. 1 being assembled to the backpack of FIG. 2 and FIG. 3, with adjustments in position of the shoulder strap assembly upon the backpack.

Referring to FIG. 4 and FIG. 5, the manner in which detachable shoulder straps assembly 100 can be attached to sleeve 202 of backpack 200, is illustrated. As a first step, the bottom end parts 104A of lower straps 104 of detachable shoulder strap assembly 100 are pushed through between lower flat part 207 of sleeve 202 and backpack 202, or if lower part 207 includes two parts, as described above, between the two parts. In either case, bottom end parts 104A of lower straps 104 emerge below the bottom of lower flat part 207 of sleeve 202.

The next step in the attachment of detachable shoulder strap assembly 100 to sleeve 202 of backpack 200 is to place the slit 103 of detachable shoulder strap assembly 100 over a continuous subset of the series of loops 209. For example, and not by way of limitation, while a total of six loops are shown in FIG. 3, a subset of four protrude through slit 103 in FIG. 4. This placement adjusts the position of backpack 200 to be relatively high with respect to detachable shoulder strap assembly 100, and thus relatively higher on the back of the person carrying backpack 200. This is in contrast to FIG. 5, wherein the slit 103 is placed over a continuous subset of the loops 209 of sleeve 202, resulting in backpack 200 being in a position lower with respect to detachable shoulder strap assembly 100, resulting in backpack 200 being relatively lower on the back of the person carrying backpack 200. It will be understood that an intermediate set of loops may be utilized, resulting in backpack 200 being in an intermediate position on the back of the person carrying backpack 200.

Figure 6:
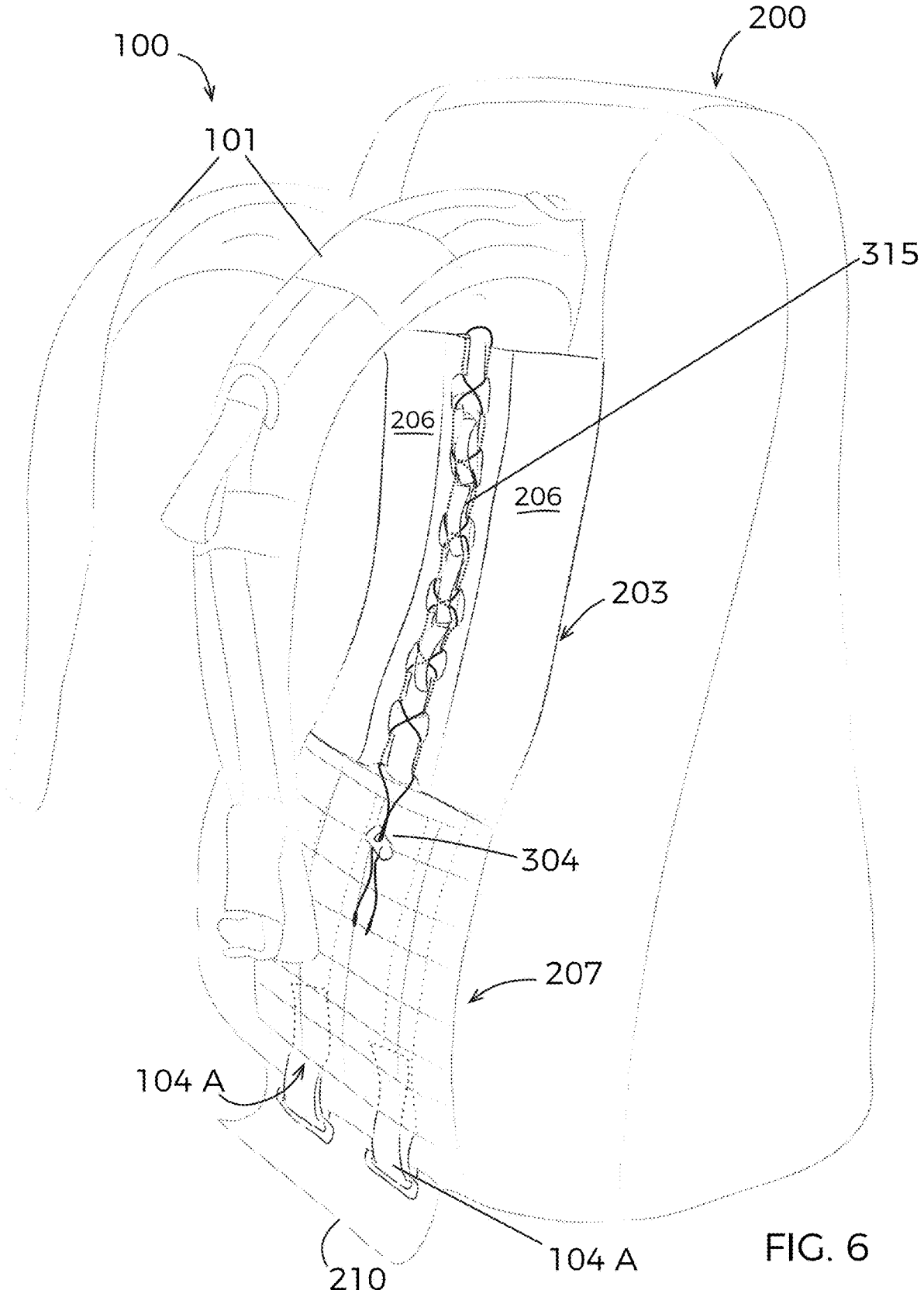
FIG. 6 is a perspective view of the shoulder strap assembly of FIG. 1 being secured in place to the backpack of FIG. 2 and FIG. 3

As illustrated in FIG. 5 and FIG. 6, bottom end parts 104A of lower straps 104 are each secured in a respective loop type buckle 212 of backpack 200.

Figure 8:
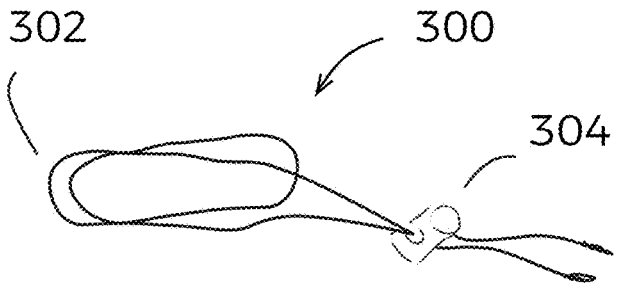
FIG. 8 illustrates a lacing string assembly used to secure the shoulder strap assembly of FIG. 2 to the backpack of FIG. 2.

Referring to FIG. 6, yoke 102 of detachable shoulder strap assembly 100 is secured or tied to those of loops 209 of sleeve 202 that protrude through slit 103 by a lacing string 302 of a lacing string assembly 300 (FIG. 8) through the loops 209. Preferably, a ladder lock 315 is formed (as described below with respect to FIG. 9) to secure yoke 102 in place on sleeve 202, in a desired position. A removable, button operated, quick string release 304, of the type commonly used on jackets for cold climates, is then used to secure the ends of lacing string 302 to one another. The bottom end parts 104A of lower straps 104 of detachable shoulder strap assembly 100 can be inserted under lower flat part 207 of sleeve 202.

Figure 7:
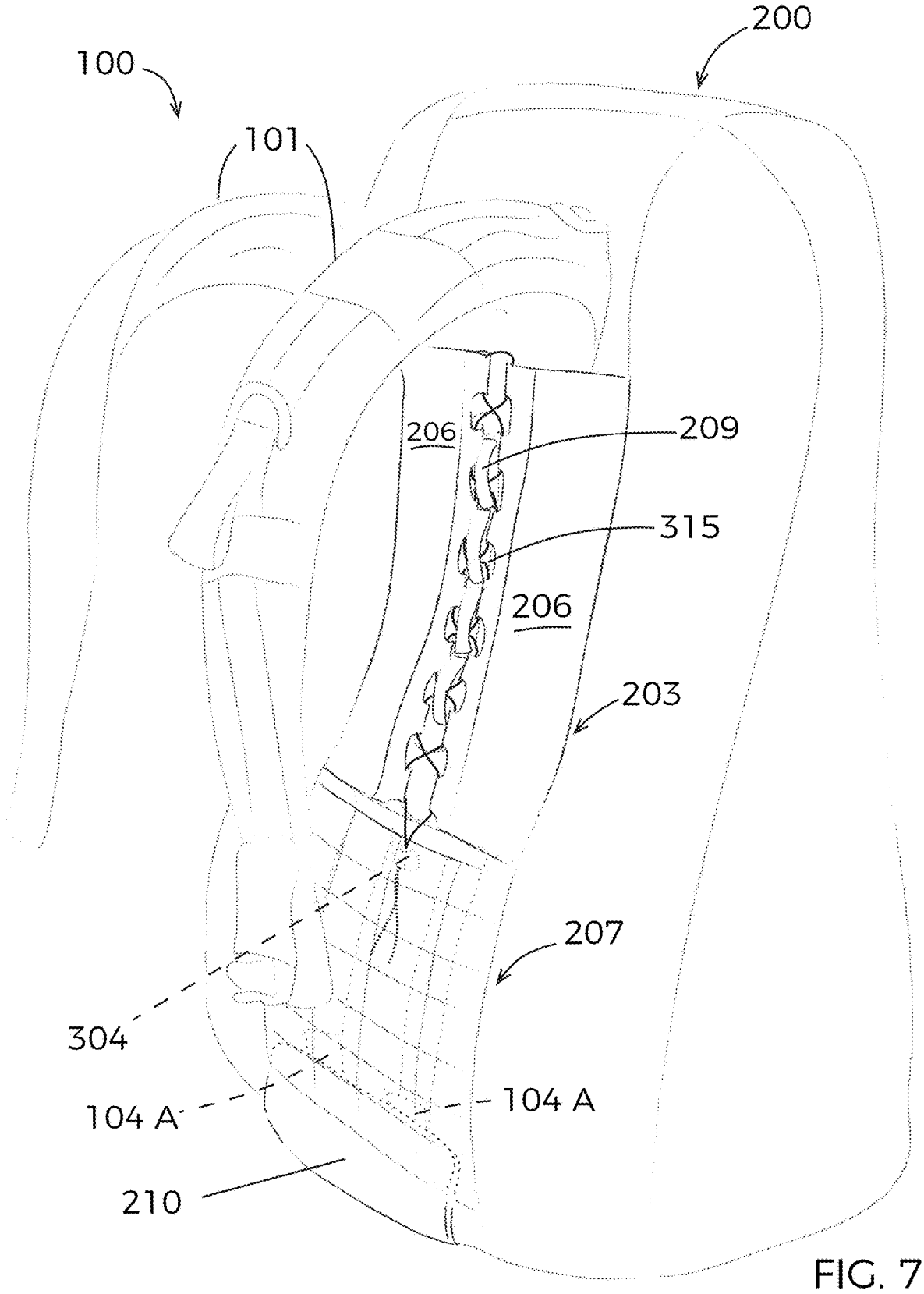
FIG. 7 is a perspective view of the completely and fully assembled combination of the shoulder strap assembly and the backpack, with covers for the securing portions in place.

As illustrated in FIG. 7, the ends of lacing string 302 and quick string release 304 can also be inserted under lower flat part 207 of sleeve 202. Pocket flap 210 can be placed over lower flat part 207 of sleeve 202, and held in place by, for example, a hook and loop fabric fastener (not shown) having corresponding opposing portions on pocket flap 210 and the outside surface of flat part 207 of sleeve 202.

Figure 9:
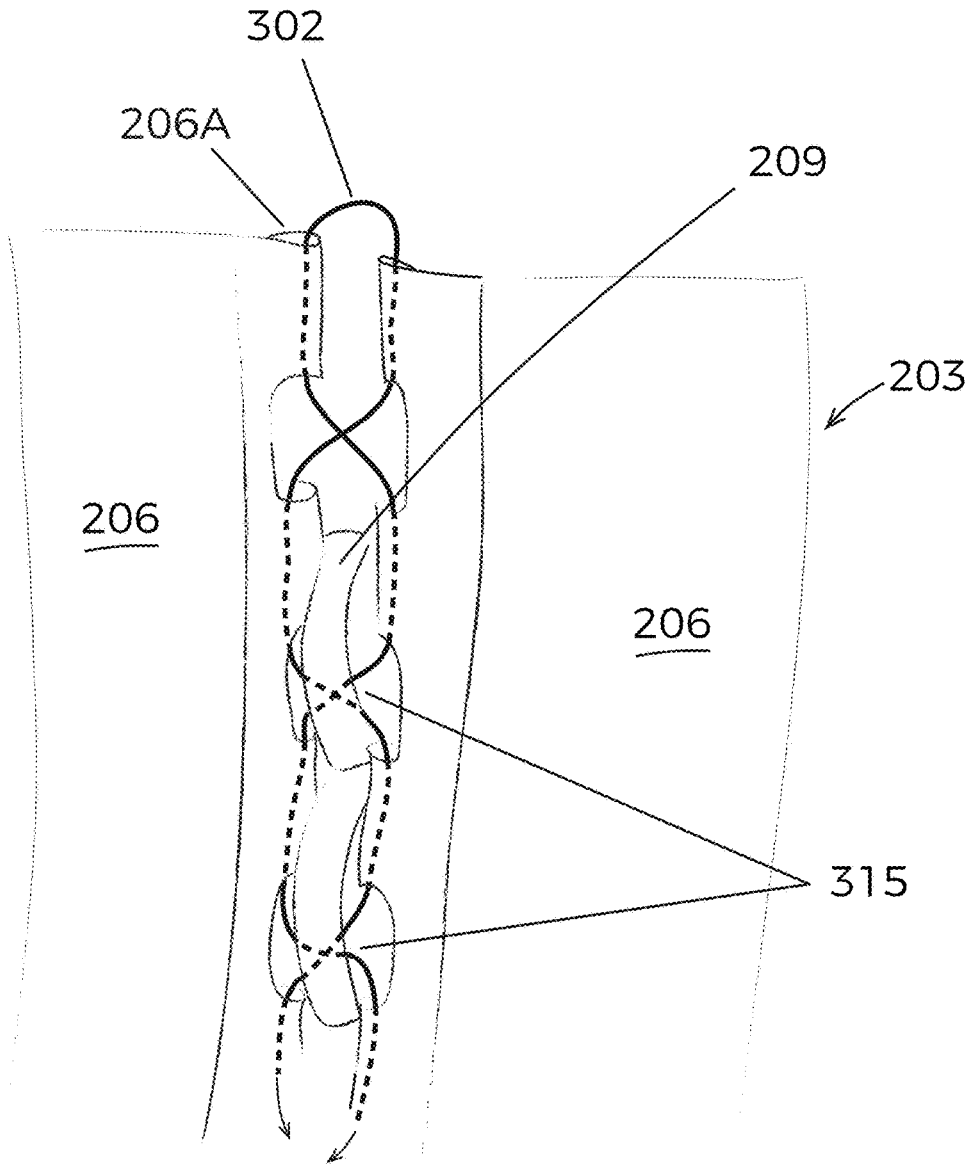
FIG. 9 is an enlarged and detailed view of the upper part of sleeve and the ladder lock of FIG. 6 and FIG. 7.

Referring to the enlargement of FIG. 9, a preferred manner of lacing string 302 to form the ladder lock 315 (also illustrated in FIG. 6), is shown. The free edges of each of flaps 206 is bend upon itself and sutured to form edge pockets 206A for receiving lacing string 302. Each of edge pockets 206A is scalloped or cut out to form a series of openings along its length which align with openings in the opposing edge pocket 206A of flap 206. Starting at the top of each of flaps 206, the ends of lacing string 302 are each inserted into a respective edge pocket 206A and pulled through to the first opening. In a manner similar to lacing a shoe, the portions of lacing string 302 are then crossed so that the one in an edge pocket at the left in FIG. 9 is inserted in the next lower portion of edge pocket 206 on the right, while the one in an edge pocket at the right in FIG. 9 is inserted in the next lower portion of edge pocket 206 on the left. At locations where a loop 209 is a positioned so that the crossing portions of lacing string 302 can be threaded through a loop 209, the ends of lacing string 302 are so threaded before being pulled through the next lower portion of edge pockets 206A. This process in continued until the lacing string 302 has been threaded through all of the loops 209 exposed through vertical slit 103, thus forming ladder lock 315. Quick string release 304 can then be applied to the ends of lacing string 312, to secure the ends of lacing string 302 to one another.

It is possible to disassemble detachable shoulder straps assembly 100 from sleeve 202 by simply reversing the attachment steps, in any logical order. Lacing string assembly 300 can be stored under lower flat part 207 of sleeve 202, or in the case of lower flat part 207 being formed as a pocket, within the pocket.

The structures and techniques described herein are exemplary, and should not be construed as implying any particular limitation on the present disclosure. It should be understood that various alternatives, combinations and modifications could be devised by those skilled in the art. Steps associated with the processes described herein can be performed in any order, unless otherwise specified or dictated by the steps themselves. For example, variations on the sequence of steps necessary to attach the detachable shoulder straps assembly 100 to the sleeve 202 are possible. The present disclosure is intended to embrace all such alternatives, modifications and variances that fall within the scope of the appended claims.

The terms "comprises" or "comprising" are to be interpreted as specifying the presence of the stated features, integers, steps or components, but not precluding the presence of one or more other features, integers, steps or components or groups thereof

What is claimed is:

1. A system for attaching shoulder straps to a backpack, comprising:

a detachable shoulder strap assembly including shoulder straps, a yoke to which the shoulder straps are attached, and at least one lower strap attached to the yoke, wherein the yoke has a slit formed therein;

a sleeve for attachment of the yoke to the backpack, the sleeve having an upper part associated with a series of loops positioned and configured to extend through the slit;

a securing member for securing the loops to the yoke; and for each of the at least one lower strap, a strap fastener for attachment to the backpack for securing the at least one strap to the backpack.

2. The system of claim 1, wherein the securing member comprises a lacing string.

3. The system of claim 2, further comprising a button operated, quick string release associated with the lacing string.

4. The system of claim 2, wherein the lacing string is used to form a ladder lock along the loops.

5. The system of claim 3, further comprising a button operated, quick string release associated with the lacing string to secure the ladder lock.

6. The system of claim 1, wherein the series of loops extends for a distance longer than a length of the slit.

7. The system of claim 1, wherein the detachable shoulder strap assembly is positioned so that one of a series of continuous subsets of the loops is positioned to extend through the slit, to adjust the position of the backpack with respect to the detachable shoulder strap assembly.

8. The system of claim 6, wherein position of the backpack with respect to the sleeve determines position of the backpack with respect to the back of a person carrying the backpack upon selection of which of a series of continuous subsets of the loops is positioned to extend through the slit.

9. The system of claim 1, wherein the sleeve has a lower portion configured as a pocket.

10. The system of claim 9, wherein the pocket is of sufficient size for storing at least the securing member.

11. The system of claim 1, wherein the strap fastener comprises a loop buckle.

12. The system of claim 1, wherein the upper part of the sleeve further comprises at least one flap for providing access to the series of loops.

13. The system of claim 1, wherein the loops are attached to the sleeve.

14. The system of claim 1, wherein the loops are attached to the backpack and extend through an opening in the sleeve and through the slit.

15. The system of claim 1, further comprising a backpack to which the sleeve is attached.

16. A method for releasably securing a detachable shoulder strap assembly to a backpack, comprising:

providing a detachable shoulder strap assembly including shoulder straps, a yoke to which the shoulder straps are attached, and at least one lower strap attached to the yoke, wherein the yoke has a slit formed therein;

attaching to the backpack a sleeve having an upper part associated with a series of loops positioned and configured to extend through the slit;

securing the yoke to the loops; and attaching the at least one lower strap, to the backpack.

17. The method of claim 16, further comprising using a lacing string to secure the yoke to the loops.

18. The method of claim 1, further comprising using the lacing string to form a ladder lock.

* * * * *